United States Patent [19]

Kaida

[11] Patent Number: 5,062,578

[45] Date of Patent: Nov. 5, 1991

[54] YARN WINDER

[75] Inventor: Masaaki Kaida, Higashiyamato, Japan

[73] Assignee: Bridgestone Corporation, Tokyo, Japan

[21] Appl. No.: 578,166

[22] Filed: Sep. 6, 1990

Related U.S. Application Data

[63] Continuation-in-part of Ser. No. 322,383, Mar. 13, 1989, abandoned.

[30] Foreign Application Priority Data

Mar. 17, 1988 [JP] Japan ..... 63-62031

[51] Int. Cl.[5] ..... B65H 54/66; A63B 45/00

[52] U.S. Cl. ..... 242/3

[58] Field of Search ..... 242/3, 4, 18 DD

[56] References Cited

U.S. PATENT DOCUMENTS

| | | | |
|---|---|---|---|
| 1,423,807 | 7/1922 | Loomis | 242/3 |
| 2,171,607 | 9/1939 | Sibley | 242/3 |
| 2,681,770 | 6/1954 | McChesney | 242/3 |

FOREIGN PATENT DOCUMENTS

| | | | |
|---|---|---|---|
| 61-211275 | 9/1986 | Japan . | |
| 25349 | of 1906 | United Kingdom | 242/3 |
| 362898 | 12/1931 | United Kingdom | 242/3 |

*Primary Examiner*—Katherine Matecki

*Attorney, Agent, or Firm*—Sughrue, Mion, Zinn, Macpeak & Seas

[57] ABSTRACT

A yarn winder for winding a yarn about a spherical body includes a pair of cylindrical rollers extending in parallel with each other in a horizontal plane and rotatively driven in the same directions and reciprocatively driven in respective axial directions opposite to each other, and a two-frustoconical roller extending in parallel with the cylindrical rollers and urged by a predetermined force against the spherical body. The two-frustoconical roller includes a center roller having a yarn guide and two taper rollers in the form of two frustocones separated from the center roller and rotatably arranged on both sides of the center roller so that smaller diameter ends of the frustocones are facing to the center roller. In operation, the time for reciprocative movement of the cylindrical rollers is so controlled that an oscillating angle of the spherical body becomes equal to a rotating angle of the spherical body.

8 Claims, 6 Drawing Sheets

YARN WINDER

This is a continuation-in-part of Ser. No. 322,383, filed Mar. 13, 1989, and now abandoned.

BACKGROUND OF THE INVENTION

This invention relates to a yarn winder for uniformly winding yarns all over outer circumferences of core members of balls for golf, baseball and the like without unevenness.

Yarn winders of this kind has been known for example as that disclosed in Japanese Patent Application Laid-open No. 61-211,275 which belongs to the assignee of the present case.

The yarn winder disclosed in the Japanese Patent Application of the prior art comprises as shown in FIGS. 1*a*–1*c* a pair of cylindrical rollers 1 extending in a horizontal plane and adapted to be rotated in the same directions and moved in respective axial directions opposite to each other, and a roller 3 in the form of two frustocones connected with their small diameter ends extending in parallel with the cylindrical rollers 1 and being forced with a predetermined force against a spherical body 2 arranged on the cylindrical rollers. With this yarn winder, the cylindrical rollers 1 are rotated in the same directions and moved in opposite axial directions so that the spherical bodies 2 positioned between the cylindrical rollers 1 and the two-frustoconical roller 3 is rotated about an axis in parallel with the cylindrical rollers 1 and two-frustoconical roller 3 in a counterclockwise direction viewed in FIG. 1*a* and is at the same time rotated about an axis perpendicular to the axes of these rollers 1 and 3 in a counterclockwise direction viewed in FIG. 1*b*. Such rotation of the spherical body 2 is affected under the action of the two-frustoconical roller 3, while the spherical body 2 is retained in position between these rollers 1 and 2. Therefore, a yarn or rubber yarn 4 fed from a guide groove 3*a* of the two-frustoconical roller through guide rollers and pulleys with braking means (not shown) is wound substantially uniformly about the overall outer circumference of the spherical body 2.

In such a winder of the prior art, however, as shown in FIG. 1*c* a radius $R_0$ of the spherical body 2 is larger than radii $R_1$ at contacting points 5*a* between the spherical body 2 and the two-frustoconical roller 3 in the rotation of the spherical body as shown in FIG. 1*a*. Therefore, a circumferential velocity of the body at the outer end of the radius $R_0$ is higher than those at the outer ends of the radii $R_1$. On the other hand, with the integrally formed two-frustoconical roller 3, a circumferential velocity of the guide groove 3*a* is lower than those at contacting points of the two-frustoconical roller 3 with the spherical body 2. As a result, a pay out velocity of the rubber yarn 4 is considerably lower than the circumferential velocity of the spherical body 2 at the outer end of the radius $R_0$ so that excessive tensile stresses act on the rubber yarn. Accordingly, there is a tendency of the rubber yarn to be cut due to the excessive tensile stresses with high probability.

In addition, when the spherical body 2 is simultaneously forced to rotate in the two directions shown in FIGS. 1*a* and 1*b*, the spherical body is rotated in an upper right hand direction shown by an arrow A in FIG. 1*c* so that one-half of the two-frustoconical roller 3 on the right side is subjected to a downwardly directing force shown by an arrow B, while a half of the roller 3 on the left side is subjected to an upwardly directing force shown by an arrow C. On the other hand, however, the two halves of the two-frustoconical roller 3 formed in a unitary body could not carry out such a free relative displacement in the external forces acting directions. Accordingly, it is actually impossible to cause the spherical body 2 to rotate in the predetermined manner. It is, therefore, very difficult to wind the rubber yarn 4 uniformly about the entire outer circumference of the spherical body 2.

SUMMARY OF THE INVENTION

It is a primary object of the invention to provide an improved yarn winder for winding yarns about balls for baseball, golf or the like, which eliminates all the disadvantages of the prior art and which is capable of winding a yarn uniformly all over an outer circumferential surface sufficiently uniformly without any risk of the yarn being cut due to excessive stresses.

In order to achieve the object of the invention, in a yarn winder for winding a yarn about a spherical body including a pair of cylindrical rollers extending in parallel with each other in a horizontal plane and rotatively driven in the same directions and reciprocatively driven in respective axial directions opposite to each other, and a two-frustoconical roller extending in parallel with the cylindrical rollers and urged by a predetermined force against the spherical body, according to the invention said two-frustoconical roller comprises a center roller having a yarn guide and two taper rollers in the from of two frustocones separated from the center roller and rotatably arranged on both sides of the center roller so that smaller diameter ends of the frustocones are facing to the center roller.

With the yarn winder, the respective components of the two-frustoconical roller are independently rotated and the taper rollers serve to rotatively drive the spherical body with contacting portions of the taper rollers in connection with the rotating velocity of the two cylindrical rollers. On the other hand, the center roller serving to wind the yarn on the spherical body is rotated at a velocity corresponding to a circumferential velocity under a predetermined tensile force acting upon the yarn. Therefore, there is no risk of the yarn which may be rubber yarn being subjected to excessive tensile forces so that cutting of the yarn is substantially completely prevented.

In this case, since the taper rollers in contact with the spherical body are subjected to external forces dependent upon rotating directions of the spherical body, the respective taper rollers can independently increase or decrease the rotating velocities in directions exerting external forces or can rotate in reverse directions, the spherical body can rotate in a predetermined manner without being subjected to uneven frictional forces between the three rollers. As a result, the yarn can be wound about the entire outer circumference of the spherical body very uniformly.

The invention will be more fully understood by referring to the following detailed specification and claims taken in connection with the appended drawings.

DETAILED EXPLANATION OF PREFERRED EMBODIMENTS

Figure 1A:
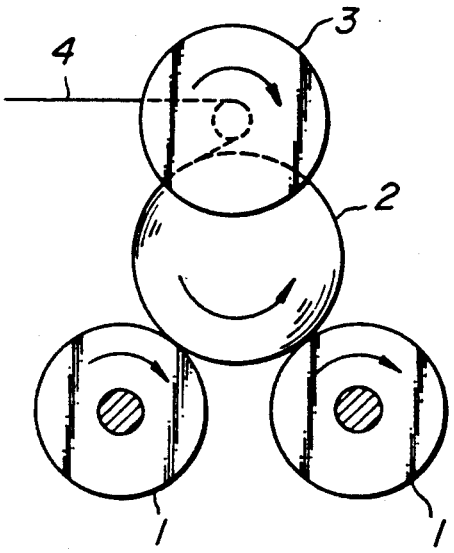
FIG. 1a PRIOR ART
FIGS. 1*a*, 1*b* and 1*c* are drawings for explaining one example of the yarn winder of the prior art.
Figure 1C:
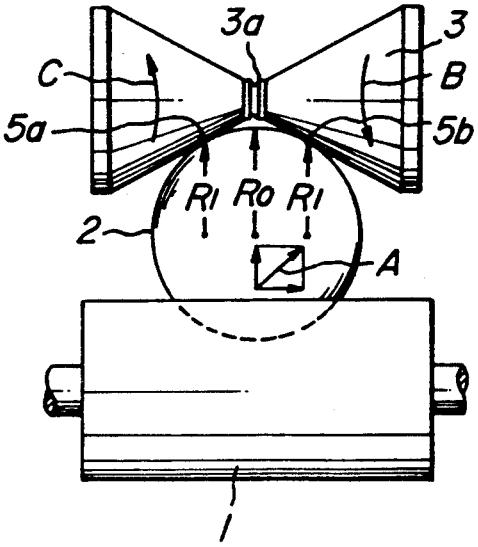
FIG. 1c PRIOR ART
Figure 1B:
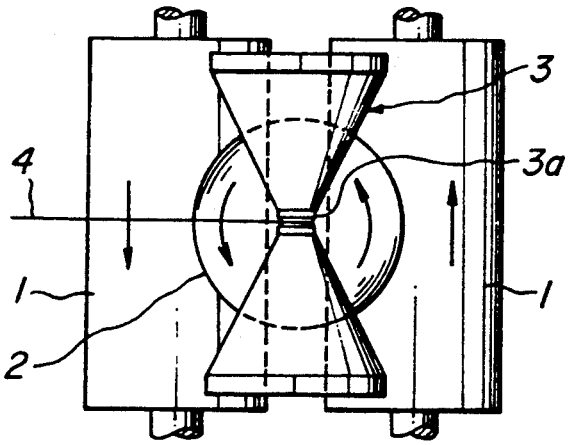
FIG. 1b PRIOR ART
Figure 2A:
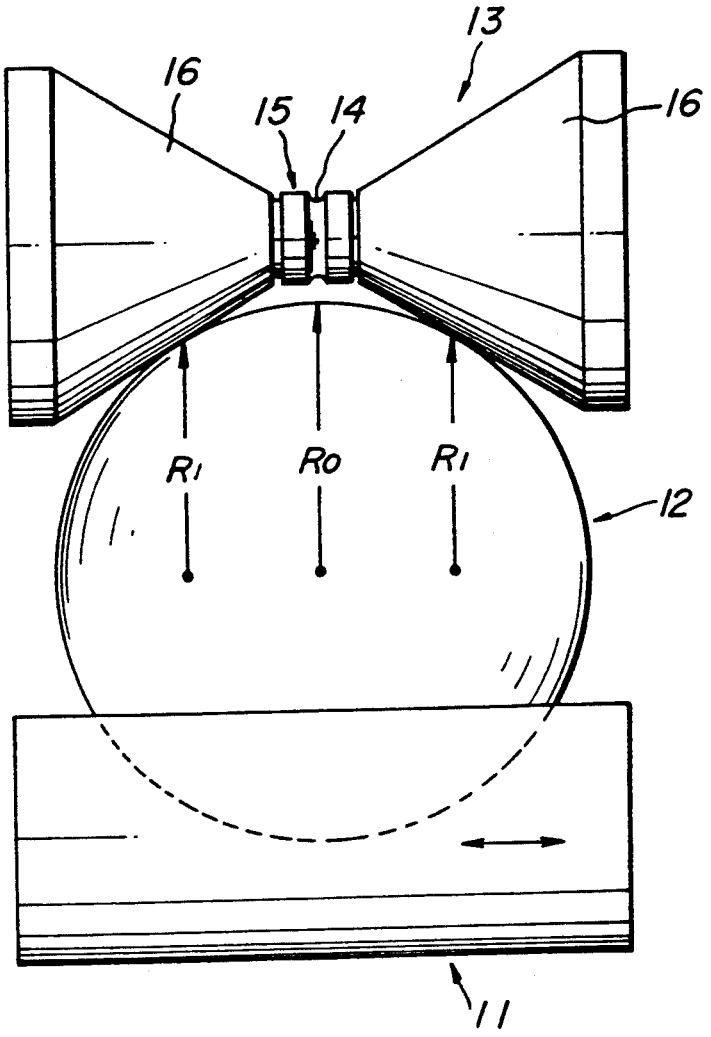
FIGS. 2*a* and 2*b* are drawings illustrating one embodiment of the device according to the invention.
Figure 2B:
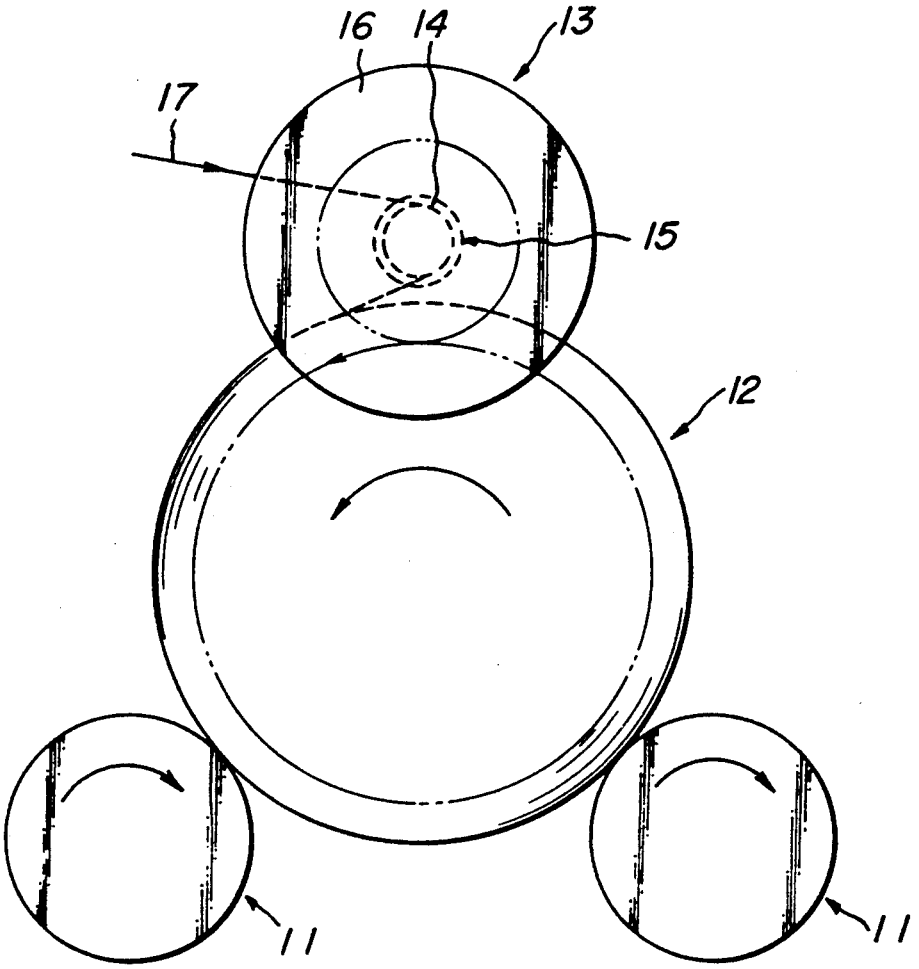

FIGS. 2*a* and 2*b* are a front elevation and a sectional view illustrating a principal of a yarn winder according to the invention by way of example. The device comprises a pair of cylindrical rollers 11 in parallel with each other similar to those of the prior art, on which a spherical body 12 is arranged, and a roller 13 in the form of two-frustocones with their small diameter ends in opposition to each other and forced against the spherical body 12 with a predetermined force.

In this case, the two-frustoconical roller 13 comprises a center roller 15 having a yarn guide 14 in the form of an annular groove, and two taper rollers 16 separated from the center roller 15 on both sides and rotatable relative to each other.

In order to avoid cutting of yarns caused by frictional forces between a rubber yarn to be wound about the spherical body 12 and the rollers 11 and 13 driving the body 12 in connection with surface hardnesses of the rollers, it is preferable that surface hardness of the cylindrical rollers 11 is 40°–60° of JIS A hardness, and surface hardness of the two-frustoconical roller 13, particularly the taper rollers 16 are 80°–100° JIS A hardness. The taper rollers 16 may be made of metal or ceramic or a combination of those materials. For example, the surface may be made from one material while the roller body is formed from the other material.

On the other hand, the center roller 15 of the roller 13 may be formed by a ceramic material of high hardness.

With the yarn winder constructed as above described, the center roller 15 is rotatable independently from both of the taper rollers 16, so that the rotating velocity of the center roller 15 serving to pay out the yarn 17 can be adapted for a velocity of the yarn 17 at the end of the radius $R_0$ which is faster than circumferential velocity of the respective taper rollers 16 serving to rotate the spherical body 12. As a result, cutting of the yarn 17 caused by excessive tensile stresses in the yarn 17 is substantially completely prevented.

In this case, moreover, the taper rollers 16 can also perform and increase or decrease of their velocities and other motions relatively independently in response to directions of external forces acting upon the taper rollers from the spherical body 12. Therefore, when the spherical body 12 performs the rotating motion in both the directions of the rotation and axial movement of the cylindrical rollers 11, the two-frustoconical roller 13 properly maintains the spherical body 12 and ensures the very smooth rotational movement of the spherical body 12. As result, the rubber yarn 17 is wound sufficiently uniformly over all of the circumferential surface of the spherical body 12.

Figure 3:
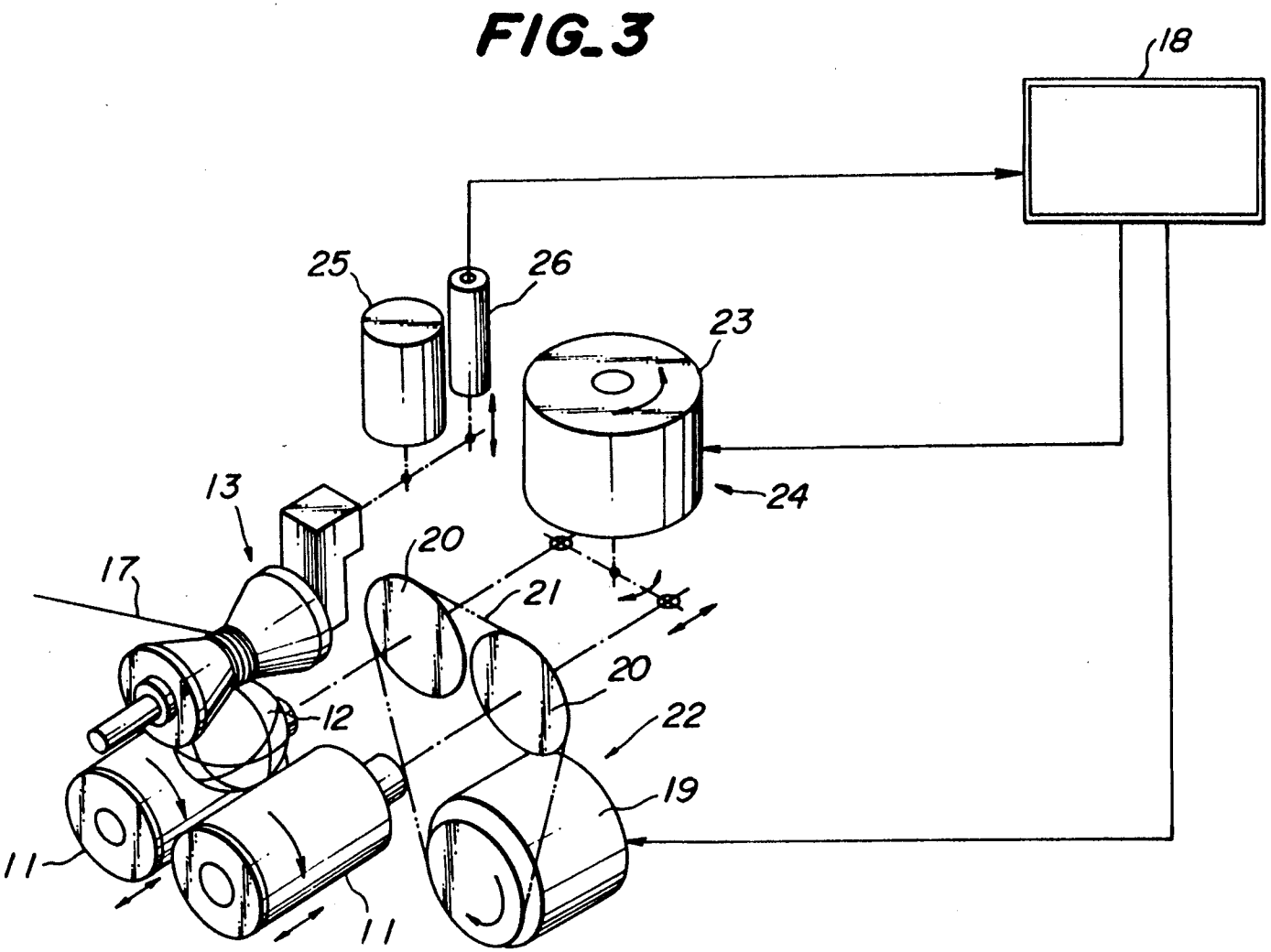
FIG. 3 is a perspective view illustrating the entire yarn winder of the first embodiment.

FIG. 3 is a schematic perspective view illustrating by way of example a yarn winder to which the two-frustoconical roller above described is applied.

In this embodiment, a pair of cylindrical rollers 11 are supported by bearings (not shown) above a base plate (not shown) so that the cylindrical rollers 11 are spaced from each other and extend in parallel with each other. A motor 19 is fixed above the base plate, whose rotating velocity is adjusted by input signals from a control unit 18. An output shaft is indirectly connected to pulleys 20 secured to the cylindrical rollers 11 through for example belts 21. The motor 19, the pulleys 20 and belts 21 form driving means 22 for rotatively driving both the cylindrical rollers 11 in the same directions at a uniform required velocity.

The cylindrical rollers 11 are provided at their rear ends with racks whose gear teeth are in opposition to each other, and on the other hand one pinion gear is secured to an output shaft of a step-motor 23, thereby forming reciprocatively driving means 24 for the cylindrical rollers 11. The reciprocatively driving means 24 enables the rollers 11 to perform the reciprocal movement in respective opposite directions in predetermined timing, with a predetermined stroke and at a predetermined speed based upon signals inputted in the control unit 18.

Moreover, the two-frustoconical roller 13 located above the cylindrical rollers 11 is connected to an air cylinder 25 for urging the two-frustoconical roller 13 against a spherical body 12 on the cylindrical rollers 11. A displacement meter 26 for detecting strokes of the air cylinder 25 is connected to the control unit 18.

With the yarn winder constructed as above described, the spherical body 12 on the cylindrical rollers 11 undergoes rotating movement and oscillation caused by the rotation and reciprocative movement of the cylindrical rollers 11, while a rubber yarn 17 is wound about the spherical body 12 progressively increasing its diameter.

When the diameter of the spherical body 12 is increased the rotating angular velocity and oscillating angular velocity of the spherical body 12 lower together, but the circumferential velocity and the reciprocating velocity of the cylindrical rollers 11 remain unchanged. As a result, intersecting angles of the adjacent turns of the yarn change. In order to avoid such a change in intersecting angle of the adjacent turns of the yarn, it is needed to detect diameters of the spherical body 12 and to control the timing of the rotation and oscillation of the body 12. For this purpose, it can be considered first to change the circumferential velocity of the cylindrical rollers 11 and second to change the timing of the reciprocating movement of the cylindrical rollers 11. In the first method, there is a risk of the yarn frequently being cut due to change in tensile force resulting from a change in winding speed of the rubber yarn 17. On the other hand, in the second method the winding speed of the yarn 17 is constant so that the risk of cutting yarn is sufficiently eliminated.

In this case, therefore, rotating angular velocity of the spherical body 12 is calculated with the aid of the circumferential speed of the cylindrical rollers 11 and diameters of the spherical body 12. Further, the reciprocating movement of the cylindrical rollers 11 is controlled by the control unit 18 so that the oscillating angular velocity of the spherical body 12 is equal to its rotating angular velocity.

Figure 4:
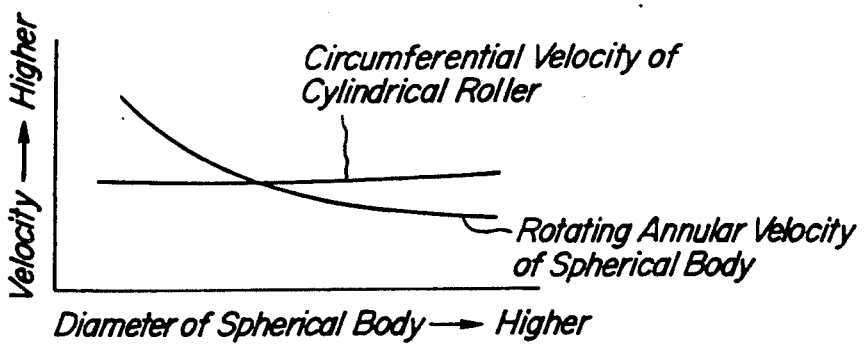
FIG. 4 is a graph showing the relation between the circumferential velocity of cylindrical rollers and diameter and angular velocity of a spherical body.
Figure 5A:
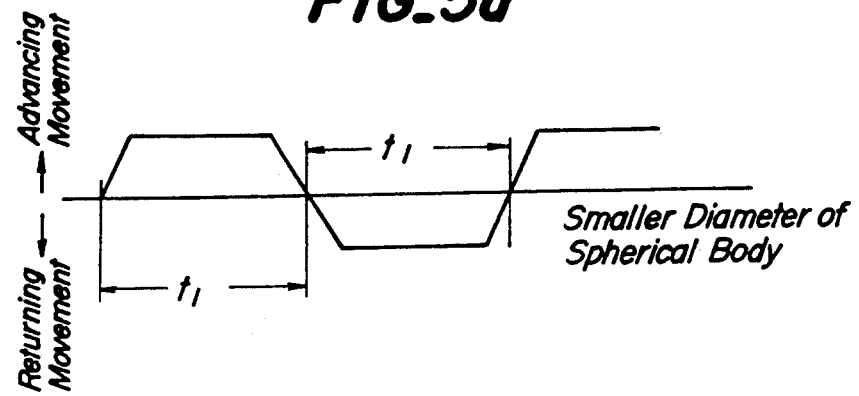
FIGS. 5*a* and 5*b* are time charts illustrating reciprocative movement of the cylindrical rollers.
Figure 5B:
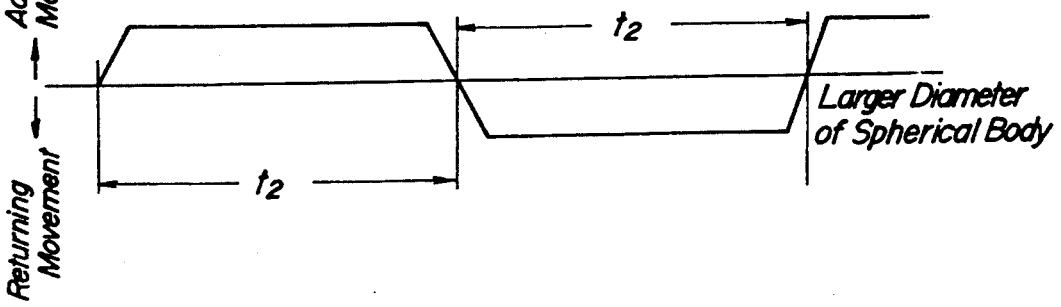

The relationship between the circumferential velocity of the cylindrical rollers 11 and the diameter and rotating angular velocity of the spherical body 12 is shown in FIG. 4. As can be seen from FIG. 4, even the circumferential velocity of the cylindrical rollers 11 is constant, the rotating angular velocity lowers as the diameter of the spherical body 12 increases. In order to make the oscillating angular velocity of the spherical body equal to its rotating angular velocity, therefore, it is required to control the oscillation of the spherical body 12 in connection with the reciprocative movement of the cylindrical rollers 11 because the oscillating angular velocity of the spherical body is dependent upon the reciprocative movement of the cylindrical rollers 11. In more detail, as shown in FIGS. 5*a* and 5*b*, the oscillation of the spherical body 12 is controlled with the predetermined stroke such that each of advancing and returning movements of the cylindrical rollers 11 is carried out for a shorter time $t_1$ when the diameter of the spherical body 12 is smaller, while for a longer time $t_2$ when the diameter of the spherical body 12 is larger.

Figure 6:
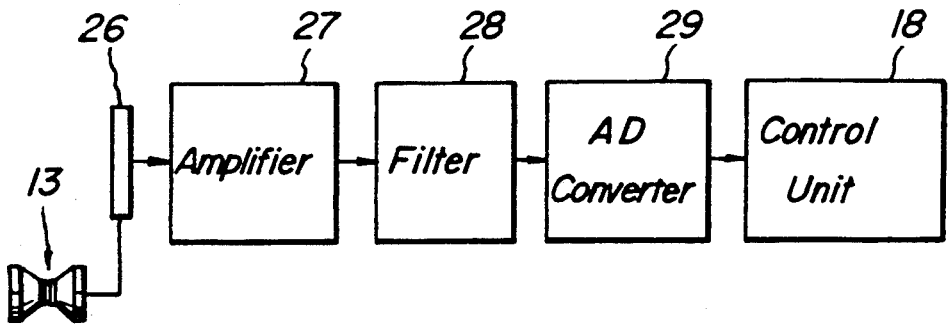
FIG. 6 is a block diagram showing processes for measuring diameters of a spherical body.

FIG. 6 illustrates means for detecting diameters of the spherical body 12 in the above control of the oscillation of the spherical body 12. A displacement meter 26 of, for example, a differential transformer type is connected to the two-frustoconical roller 13 for detecting displacement of the roller 13 in vertical directions. A value detected by the meter 26 is amplified by an amplifier 27 to a voltage of DC 0–2 volts. The amplified voltage is inputted into the control unit 18 successively through a filter 28 and an A-D converter 29.

Figure 7:
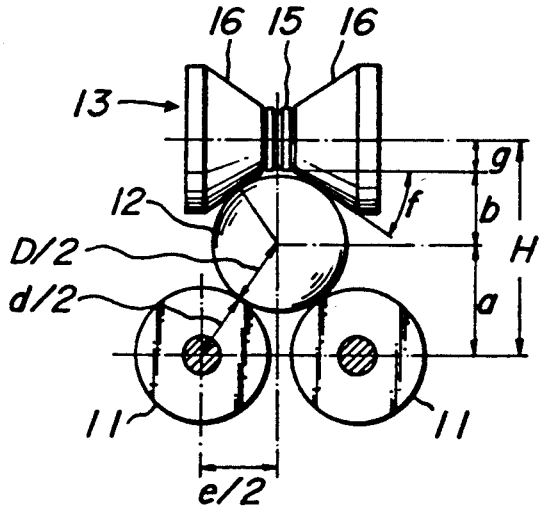
FIG. 7 is a drawing illustrating relationship between diameter of a spherical body and two-frustoconical roller and cylindrical rollers.

In this case, the relation between the change in diameter of the spherical body 12 and the displacement detected by the differential transformer type displacement meter 26 as shown in FIG. 7. It is assumed that the diameter of the spherical body is D, the diameters of the cylindrical rollers 11 is d, a distance between axes of the cylindrical rollers 11 is e mm, a radius of the center roller 15 of the roller 13 is g, and a taper angle of the taper roller 16 is f°. A distance a between axes of the cylindrical rollers 11 and a center of the spherical body 12 is indicated by the following equation.

$$a=(d/2+D/2)^2-(e/2/^2 \text{ (mm)}$$

A distance b between the center of the spherical body 12 and the center roller 15 is indicated in the following manner.

$$b=(D/2)\cos f \text{ (mm)}$$

On the other hand, a distance H between the axes of the cylindrical rollers 11 and an axis of the two-frustoconical roller 13 is indicated by H=a+b+g. Therefore, the diameter D of the spherical body 12 is very easily calculated with the aid of the control unit 18 by detecting the distance H by means of the differential transformer type displacement meter 26.

In this case, moreover, control of operating timing of the step-motor 23 to render the oscillating angular velocity of the spherical body coincident with its rotating angular velocity is carried out by detecting the rotating angular velocity of the spherical body 12. However, an actual rotating angular velocity of the body 12 is difficult to be detected. Therefore, the rotating angular velocity of the cylindrical rollers 11 is used in place of that of the spherical body 12.

Assuming that the rotating velocity of the cylindrical rollers 11 is V (rpm) and the diameter of the spherical body 12 is D, the time required for rotation of the cylindrical rollers 11 through 1° is Tr=60/(Vx360) (sec).

On the other hand, the time required for rotation of the spherical body 12 through 1° is Tb=TrxD/d (sec).

Therefore, the time required for rotation of the spherical body 12 through $\theta$ is T=Trx$\theta$=KxDx$\theta$/V (sec), where K=60/(360xd). The time T is proportional to the relating angle $\theta$ and the diameter D of the spherical body 12 and inversely proportional to the rotating velocity V of the cylindrical rollers 11.

In case that the rotating velocity V of the cylindrical rollers 11 is constant, therefore, the time for the reciprocative movement of the cylindrical rollers is controlled so that an oscillating angle of the spherical body 12 becomes equal to its rotating angle $\theta$° in order to wind the rubber coated yarn on all the circumferential surface of the spherical body 12 sufficiently uniformly without cutting of the yarn.

As can be seen from the above explanation, according to the invention, the two-frustoconical roller comprises the center roller and the taper rollers separated from the center roller and rotatably arranged one on each side of the center roller. The cutting of yarn or rubber yarn is substantially completely prevented. In addition, the yarn is sufficiently uniformly wound on all the circumference of a spherical body.

While the invention has been particularly shown and described with reference to preferred embodiments thereof, it will be understood by those skilled in the art that the foregoing and other changes in form and details can be made therein without departing from the spirit and scope of the invention.

What is claimed is;

1. A yarn winder for winding a yarn about a spherical body including a pair of cylindrical rollers extending in parallel with each other in a horizontal plane and rotatively driven in the same directions and reciprocatively driven in respective axial directions opposite to each other, and a two-frustoconical roller extending in parallel with the cylindrical rollers and urged by a predetermined force against the spherical body, wherein said the two-frustoconical roller comprises a center roller having a yarn guide and two taper rollers in the form of two frustocones separated from the center roller and rotatably arranged on both sides of the center roller so that smaller diameter ends of the frustocones are facing to the center roller and wherein a surface hardness of the cylindrical rollers is in the range of 40°–60° JIS A hardness and a surface hardness of said taper rollers is in the range of 80°–100° JIS A hardness.

2. A yarn winder as set forth in claim 1, wherein said yarn winder comprises driving means for rotatively driving both the cylindrical rollers in the same directions at a uniform required speed, reciprocatively, driving means for reciprocatively driving the cylindrical rollers in respective axial directions opposite to each other, urging means for urging the two-frustoconical roller against a spherical body on the cylindrical rollers, a displacement meter for detecting displacement of the two-frustoconical roller, and a control unit for controlling the driving means, the reciprocatively driving means and the urging means.

3. A yarn winder as set forth in claim 2, wherein said displacement meter is connected to the control unit through an amplifier, a filter and an A-D converter.

4. A yarn winder as set forth in claim 2, wherein said control unit controls a time for reciprocative movement of the cylindrical rollers to make an oscillating angle of the spherical body substantially equal to a rotating angle of the spherical body.

5. A yard winder according to claim 2 wherein said urging means comprises an air cylinder.

6. A yarn winder according to claim 2 wherein said driving means for reciprocatively driving the cylindrical roller comprises a step motor having an output pinion gear, a rack coupled to each of said cylindrical rollers, each rack having gear teeth in opposition to each other and said pinion gear coupled to said teeth for driving said cylindrical rollers in respective axial directions opposite to each other.

7. A yarn winder according to claim 1 wherein said taper rollers are made at least in part from a ceramic material.

8. A yarn winder according to claim 1 wherein said taper roller are made at least in part from a metal.

* * * * *